United States Patent [19]

Pritchett

[11] Patent Number: 4,678,104

[45] Date of Patent: Jul. 7, 1987

[54] COLD PLATE FOR BEVERAGE DISPENSING

[75] Inventor: James D. Pritchett, Plano, Tex.

[73] Assignee: Booth, Inc., Dallas, Tex.

[21] Appl. No.: 670,618

[22] Filed: Nov. 13, 1984

[51] Int. Cl.[4] ..... B67D 5/62

[52] U.S. Cl. ..... 222/146.6; 62/344; 165/136; 165/169

[58] Field of Search ..... 222/146.6; 165/136, 165/169; 62/344; 220/327, 325

[56] References Cited

U.S. PATENT DOCUMENTS

| | | | |
|---|---|---|---|
| 560,309 | 5/1896 | White | 220/327 |
| 2,505,828 | 5/1950 | Fox | 4/632 |
| 4,059,199 | 6/1976 | Quaney | 220/327 |
| 4,195,754 | 4/1980 | Heier | 222/146.6 |
| 4,204,613 | 5/1980 | Terzian et al. | 222/146.6 |
| 4,423,830 | 1/1984 | Lents et al. | 222/146.6 |

FOREIGN PATENT DOCUMENTS

| | | | |
|---|---|---|---|
| 0844953 | 8/1960 | United Kingdom | 222/146.6 |

*Primary Examiner*—Joseph J. Rolla
*Assistant Examiner*—David H. Bollinger
*Attorney, Agent, or Firm*—Richards, Harris, Medlock & Andrews

[57] ABSTRACT

A cooling system for dispensing beverages is provided having a tubular tub open at the top and bottom and adapted to receive a cold plate. The cold plate has cooling coils cast within it and is easily disassembled from the tub. The tub has a ledge near the bottom. The ledge features a groove for holding a gasket, and a channel for receiving threaded lugs. The cooling plate has bolt holes which correspond to the lugs. Bolts are inserted through the cooling plate and into the lugs. Tightening the bolts creates a watertight seal between the plate and the tub. The present cooling system is thus readily disassembled for ease of repair.

6 Claims, 3 Drawing Figures

COLD PLATE FOR BEVERAGE DISPENSING

TECHNICAL FIELD

This invention relates to dispensers of beverages where intermittent demand at high volume is encountered in operation of pressurized sources of water and syrup.

BACKGROUND ART

The demands placed on soft drink dispensing systems vary widely. In situations where large amounts of beverage are to be provided, pre-mix beverages or post-mixed constituents are fed from a supply cylinder under pressure through coils embedded in a cold plate and thence to a cup or other container. Cold plates heretofore employed have formed the bottom closure member of a tub. Water and syrup lines pass into the cold plate which generally is a solid cast metallic plate preferably of high heat transfer character. With the bottom of the tub closed by the cold plate, the tub can be repeatedly filled with ice to maintain a low temperature of the cold plate. Replenishment repeatedly is required when large quantities of the beverage are involved. Cold plates have heretofore been employed in the dispensing of beverages. The beverages can be and have been both pre-mix and post-mix. Post-mix drinks represent the most efficient way to operate under high demand. By the present invention, access to cold plate systems and parts thereof requiring repair or replacement may readily be had and thus represents an improvement over systems in prior use.

DISCLOSURE OF THE INVENTION

The present invention involves providing a cold plate where beverages, either pre-mix or post-mix, may pass through supply lines for flow of cooled beverages from a dispenser. In a more specific aspect, there is provided a tub having walls spaced apart horizontally for receiving foamed insulation. The tub has threaded inserts to receive fastening means. A gasket which is faced downward contacts the upper surface of the cold plate and the lower edge surface of said tub. Means are then provided to force the walls of the tub onto said cold plate to cause the gasket to seal the common boundary of the tub and cold plate. By this means, a fluid tight bottom-sidewall joint is provided which can be readily disassembled for repair or cleaning.

BRIEF DESCRIPTION OF THE DRAWINGS

For a more complete understanding of the invention and its object and advantages thereof reference may now be had to the following description taken in conjunction with the accompanying drawings in which.

DETAILED DESCRIPTION

Figure 1:
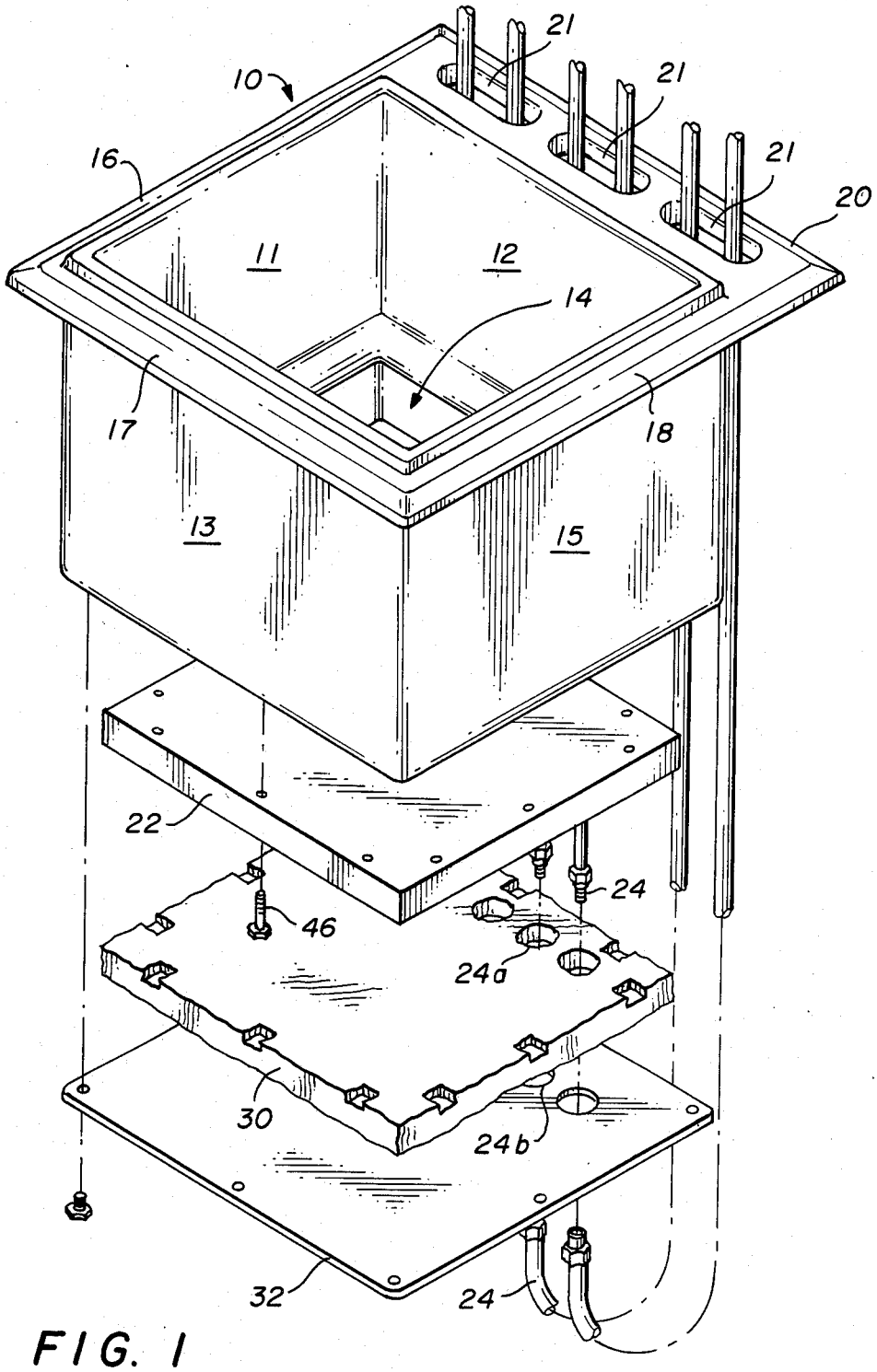
FIG. 1 is an exploded view of the cold plate unit in accordance with the present invention.
Figure 3:
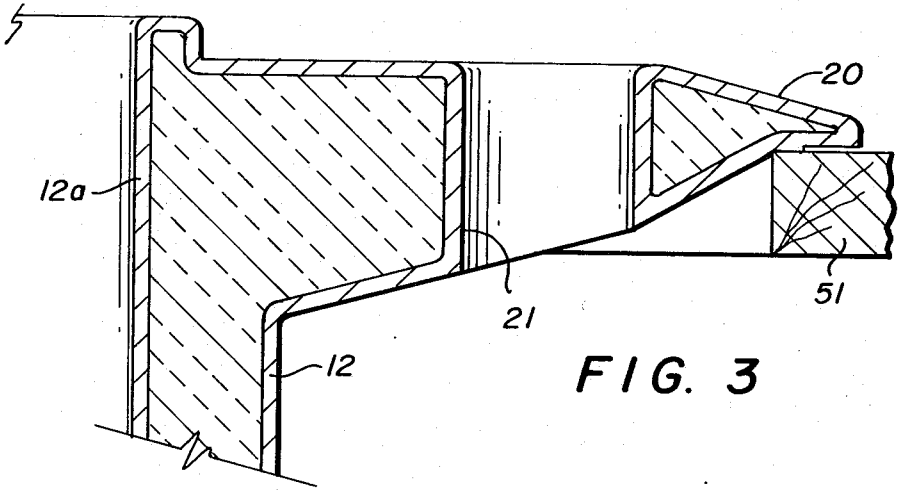
FIG. 3 is a sectional view of another portion of a cold plate.
Figure 2:
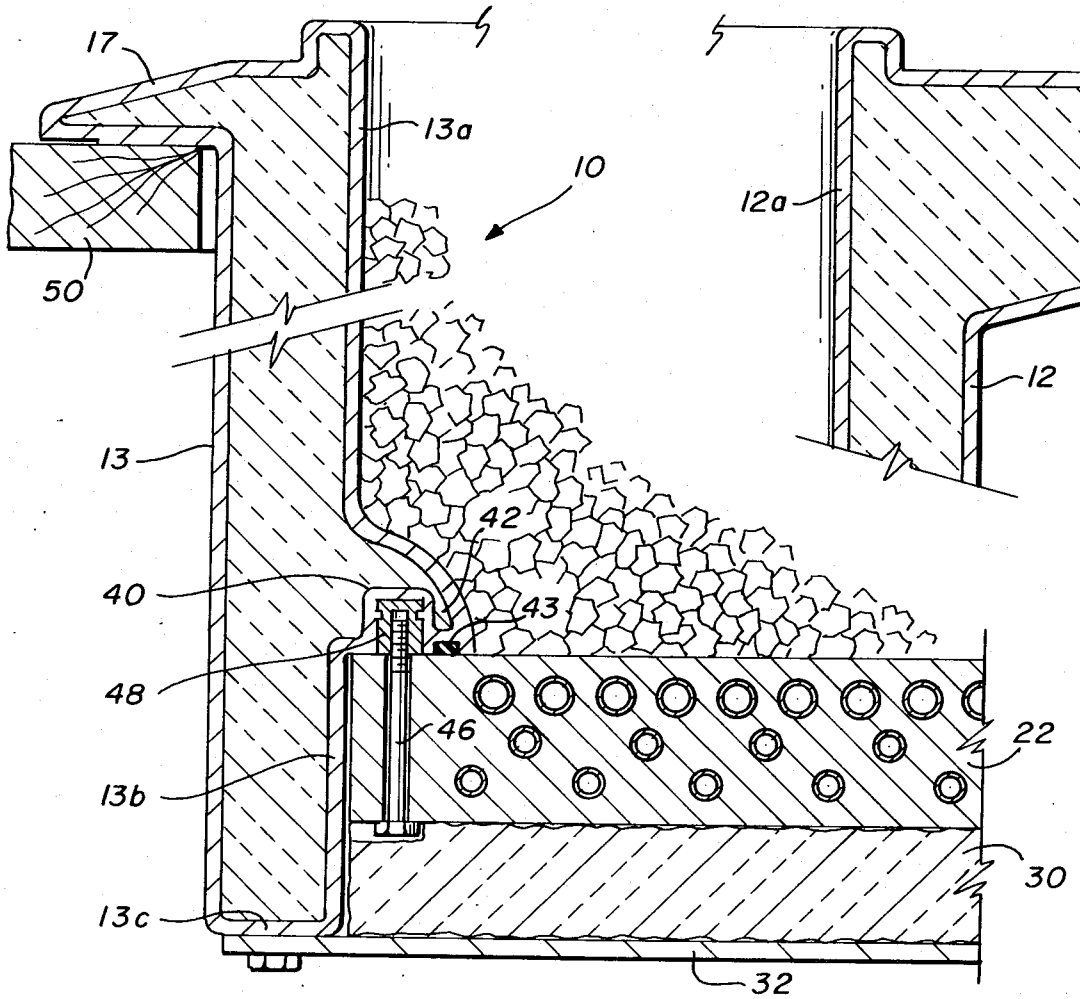
FIG. 2 is a sectional view of a portion of the cold plate structure of FIG. 1.

FIGS. 1–3 illustrate a preferred form of a cold plate beverage dispensing system. A tub 10 has interior walls 11 and 12. The walls are dual panel walls with the space between them filled with insulation which serves to minimize heat loss through the walls 11 and 12. The tub 10 initially has an open bottom 14. The lower edges of the wall panels 11 and 12 are shaped to receive a gasket in downward facing portions of the walls 11 and 12. The tub 10 has flanges 16, 17 and 18 which when in place rest on a table top or a bar which has an opening to receive tub 10. The flange 20 on wall 12 has plurality of holes therethrough in the upper portion thereof. Tubes passing through cooling coils in the cold plate may be routed out of the nest occupied by the tub 10 through such holes.

Cold plate 22 is immediately below tub 10. Plate 22 has lateral dimensions as to match the bottom of the sidewalls. Cold plate 22 is of cast metal with a plurality of water and syrup lines connected to the coiled arrays in plate 22 and leading through openings 21 of flange 20. Such lines may then be readily connected to pressurized liquid supply units for flow in syrup lines and one or more water lines as may be necessary to meet the demand. Output lines are employed for filling cups or other containers.

Thus, multiple water and syrup lines lead from pressurized sources through the openings 21. They are to be connected to coils in the bottom panel which is cold plate 22. As shown in FIG. 1, six lines supply syrup and water in response to demands. Thus, water lines and syrup lines would be cast in cold plate 22. The connector 24 is represented in front below the cold plate. A preferred embodiment of the cold plate involves multiple coils with inlet and outlet fittings on one side of the cold plate, some for syrup and some for water. The supply and demand for mixed beverage is by way of extensions of the water and syrup lines which are molded in cold plate 22 and extend to dispensing valves that are manually operated.

Bolt 46 passes upward through a suitable hole in the cold plate and engages downwardly facing threaded inserts. Other bolts 46 are received around the periphery of the cold plate and the tub 10 so that the cavity inside the molded tub 10 may be supplied ice and will not leak. The system then operates to provide cold beverages through a suitable dispensing valve.

Below the cold plate 22 is a pad 30 of suitable insulation. Below the layer 30 is a bottom plate 32, a metal plate that is secured to the bottom of the stack comprising tub 10, cold plate 22, and insulation 30.

Below connector 24 holes **24*a* and 24*b* accommodate a water or syrup line leading to the connector 24. In such case, the water or syrup line connected to connector 24 passes downward through holes 24*a* and 24*b*. They then reverse direction and pass upward along the side of the tub and extend from one of the holes 21 for connecting to the syrup and water supply lines. Similarly, syrup and water lines emerge from the cold plate in the same manner as shown in FIG. 1, but serve to deliver the cooled constituents through the apertures 21** to dispensing valves.

Referring now to FIG. 2, it will be noted that the tub 10 has a flange. The sidewall 13 of the tub comprises an outer panel **13*a* and an inner panel 13*b*. The cavity between walls 13 and 13*a* are filled with foam insulating material. The bottom of the tub is provided with a short riser 13*b* and a bottom closure panel 13*c*. The top of the riser 13*b* has a plurality of threaded downward facing bosses 40. The inner panel 13*b* of the side panel 13 is curved inwardly at a point corresponding with the boss 40. The bottom edge of the panel 13*b* is semicylindrical in shape as shown at 42. A gasket 43 is fitted into the groove 42 of panel 13*b*. Cold plate 22 is mountable inside the cavity formed by the walls such as wall 13***a* and 13*b* and the lower end of the side panel 13*b*. Bolt 46 extends from the bottom surface of the cold plate 22 upward into the threaded fixture 48 in boss 40.

As noted above, a plurality of bolts such as illustrated by bolt 46 are located at spaced points on the periphery of unit. They establish and maintain the watertight seal between the inner wall panel 13*a*, including the gasket 43, so that ice cubes may be maintained in the tub 10 with cold water and syrup lines passing through the cold plate.

Cold plate 22 can be readily disassembled for repair or replacement. This is made possible by providing fastening means or lugs such as 48 in the sidewall at various locations around the perimeter. For example, in order to repair or replace the cold plate 22, the fasteners connecting the base plate 22 through the rest of the system may be removed. The insulating plate 30 will readily be removed. The bolts 46 can then be loosened and disconnected from the threaded lug 48. The cold plate 22 may then merely be dropped out of the tub for repair or replacement. Once the matter is settled, reverse steps can be followed to reestablish the unitary nature of the construction involved.

Thus, in accordance with the invention a dispenser of cold drinks is provided through the use of a cold plate, a metal casting through which supply lines pass from a supply system to dispensing valves. The cold plate serves as a heat exchanger and is maintained in a tub wherein ice cubes are supplied to the top of the tub which forms a closure member for the bottom of the tub. Built into the walls of the tub is a series of threaded receptacles or lugs. Holes are provided in the periphery of the cold plate to match the array of lugs. Bolts which pass upward through the cold plate are served into the threaded lugs and force the bottom edge of the tub onto the top face of the cold plate. A gasket between the latter two makes a water tight seal and ease of assembly between the cold plate and tub for a mechanical joint.

Having described the invention in connection with certain specific embodiments thereof, it is to be understood that further modifications may now suggest themselves to those skilled in the art, and it is intended to cover such modifications as fall within the scope of the appended claims.

I claim:

1. A cooling system for dispensing beverages comprising:

(a) a tubular tub member, adapted for disassembly with a cooperating cooling-plate, open at the top and bottom and defining an inner wall, said tub member having a ledge portion extending from the inner wall of the tub member into the interior thereof about the entire periphery of the inner wall at a given distance from the bottom of the tub member, said ledge having a planar downwardly facing rabbet and a channel;

(b) a flat cast metal cooling plate, adapted for disassembly from the tub member, having syrup and water cooling coils cast in said plate, said metal plate having a plurality of bolt receiving holes passing therethrough distributed about the periphery of the metal plate near the exterior edges of the metal plate;

(c) a resilient gasket for positioning between the downwardly facing rabbet of said tub and the top of the plate to form a watertight seal between the plate and the tub;

(d) said channel adapted to receive a plurality of threaded inserts, said inserts opening through the rabbet;

(e) a plurality of bolts, each bolt inserted through a hole in said metal plate from the bottom of the plate to threadedly engage a threaded insert to compress the resilient gasket between the top surface of the metal plate and the rabbet to form a water tight seal therebetween, said bolts thereby adapted for disassembly of the plate from the tub member, whereby said tub member may be readily repeatedly filled with ice for maintaining said plate at a low uniform temperature while cooling cold beverages which pass through said coils and which may readily disassemble for ease of repair and cleaning.

2. The combination set forth in claim 1 in which the bottom surface of said cold plate is covered by a plate of insulating material and which in turn is covered by a metal finish plate.

3. The combination set forth in claim 1 in which the rabbet has formed therein a continuous groove adapted to receive and hold said gasket in place.

4. A cooling system for beverages, comprising:

a tub member adapted for disassembly with a cooperating cooling plate, open at the top and bottom thereof, said tub member having an inner wall and an outer wall, the tub member having insulation material between said walls, a flange extending outwardly from the outer wall of said tub member near the top for engaging a table top, said inner wall having a ledge portion extending into the interior of the tub member about the entire periphery of the inner wall, said ledge portion including a rabbet, the rabbet having formed therein a continuous downward facing groove and a channel located between the continuous groove and the inner wall, the channel adopted to receive a plurality of threaded inserts;

a plurality of threaded inserts adapted to be received in the channel;

a cold plate having syrup and water cooling coils cast therein and adapted for disassembly from the tub member, said plate having a generally flat upper surface and a generally flat lower surface, the various inlet and outlet connections for the coils within the cold plate extending downward from the bottom surface of the plate, said plate having a plurality of openings therethrough near the outer edge of the plate;

a resilient gasket to be received in the groove in the ledge of the tub member for forming a watertight seal between the top surface of said cold plate and the ledge of the tub member; and a plurality of bolt means for threaded engagement with the threaded inserts in the channel, through the cold plate to compress the resilient gasket between the rabbet and top surface of the cold plate to form a watertight seal therebetween adapted thereby for disassembly of the cold plate from the tub member and permitting the tub member to be filled with ice to maintain the liquids flowing through the coils cast into said plate at a low temperature.

5. The cooling system of claim 4 further comprising a metal finish plate bolted to the bottom edge of said tub member and insulation packed between the bottom surface of the cold plate and said finish plate.

6. The cooling system of claim 5 wherein said finish plate and insulation have apertures formed therein for passage of the lines supplying syrup and water to the cold plate, a portion of said flange of said tub member further having an opening therein for passage of said lines upward of said tub member.

* * * * *